US005201142A

United States Patent [19]

Rouwendaal

[11] Patent Number: 5,201,142

[45] Date of Patent: Apr. 13, 1993

[54] REVOLVING DOOR

[75] Inventor: Josephus A. M. Rouwendaal, Wormerveer, Netherlands

[73] Assignee: Boon Edam B.V., Edam, Netherlands

[21] Appl. No.: 810,236

[22] Filed: Dec. 19, 1991

[30] Foreign Application Priority Data

Jan. 21, 1991 [NL] Netherlands ..... 9100092

[51] Int. Cl.[5] ..... E05D 15/02

[52] U.S. Cl. ..... 49/42

[58] Field of Search ..... 49/42, 43, 46, 324

[56] References Cited

U.S. PATENT DOCUMENTS

| | | | |
|---|---|---|---|
| 1,920,397 | 8/1933 | Johnson | 49/42 |
| 3,440,759 | 4/1969 | Riddle | 49/43 |
| 4,060,935 | 7/1977 | Miller et al. | 49/42 X |
| 4,341,165 | 7/1982 | Calandritti et al. | 49/42 X |
| 4,991,347 | 2/1991 | Takimoto et al. | 49/40 |

FOREIGN PATENT DOCUMENTS

| | | | |
|---|---|---|---|
| 324686 | 9/1920 | Fed. Rep. of Germany | 49/42 |
| 3008782 | 10/1980 | Fed. Rep. of Germany | 49/42 |
| 7902203 | 9/1980 | Netherlands . | |

*Primary Examiner*—Peter M. Cuomo
*Assistant Examiner*—Jerry Redman
*Attorney, Agent, or Firm*—Pennie & Edmonds

[57] ABSTRACT

A revolving provided with a number of door wings which can be driven with the aid of a drive mechanism. This comprises a chain running in a substantially horizontal plane along a number of chain wheels in an essentially polygonal path and operatively engaging at least one door wing via a carrier. This carrier comprises two hinged rods which engage the chain at two spaced apart points and are interconnected via a lever which is movably and driveably connected to the door wing.

8 Claims, 1 Drawing Sheet

REVOLVING DOOR

The invention relates to a revolving door comprising number of substantially horizontally turning door wings, which can be driven by means of a drive mechanism provided with elongate driving means running in a substantially horizontal plane along a number of guide units in an essentially polygonal path and operatively engaging at least one door wing by means of carrier means.

In a known embodiment of a revolving door of this type the carrier consists of a rod hinged on one end to the driving means and on the other end to the door wing. Thus the rod converts a movement along a polygonal track (of the driving means) into an oval movement of the door wing.

When the driving means uniformly moves at a constant speed this will result in a non-uniform movement of the door wings, having a relatively high degree of non-uniformity. In addition, as the connection point between the driving means and the rod is running along a guiding means, the changes in direction of said connection point at the corners of the polygonal path are rather abrupt, which will cause the door wing to move jerkily. These two phenomena lead to increased wear as a result of the higher load to which the parts concerned are subjected as well as to a loss in driving power.

The object of the invention is to provide a revolving door of the type disclosed in the preamble, in which said disadvantages are effectively eliminated or reduced.

In order to achieve this object the revolving door according to the invention is characterized in that the carrier means comprises at least two hinged carrier elements, each engaging the driving means at two spaced apart points and being interconnected by coupling means which are movably and drivably connected to the door wing.

By virtue of the features according to the invention both the non-uniformity of the speed at which the door wings move and the shock effects to which they are subjected can be reduced because the movement of the door wings is now determined by the movements of two carrier elements, said movements being transmitted to the door wings by the coupling means. The fluctuations in movement of the two carriers will counterbalance each other at least partially, resulting in a lower degree of non-uniformity of the door wings movement, while at the same time also reducing the jerky effect of the one carrier element due to the movement of the other one.

Preferably the carriers consist of elongate connecting members, such as rods, in which for instance the carrier elements comprise one essentially pulling element and one essentially pushing element.

A simple embodiment of the revolving door according to the invention is characterized in that the coupling means is provided with a two-armed lever, the two lever arms of which being connected to the carrier elements and the lever itself, at a position between its arms, being hinged to the door wing.

Due to its rotation this lever can easily counterbalance the variations in the mutual distance of the connection points between the carrier elements and the driving means, and, provided the dimensions are well-chosen, this will hardly affect the movement of the door wings.

A profitable reduction of the degree of nonuniformity of the door wing movement can be achieved when the length of the driving means between the connection points with the two carrier elements is in the range from one half to twice the length of a shortest side of said polygon and preferably approximates the length of the shortest side.

The invention will be further described below with reference to the drawings illustrating very schematically one embodiment of the invention.

Figure 1:
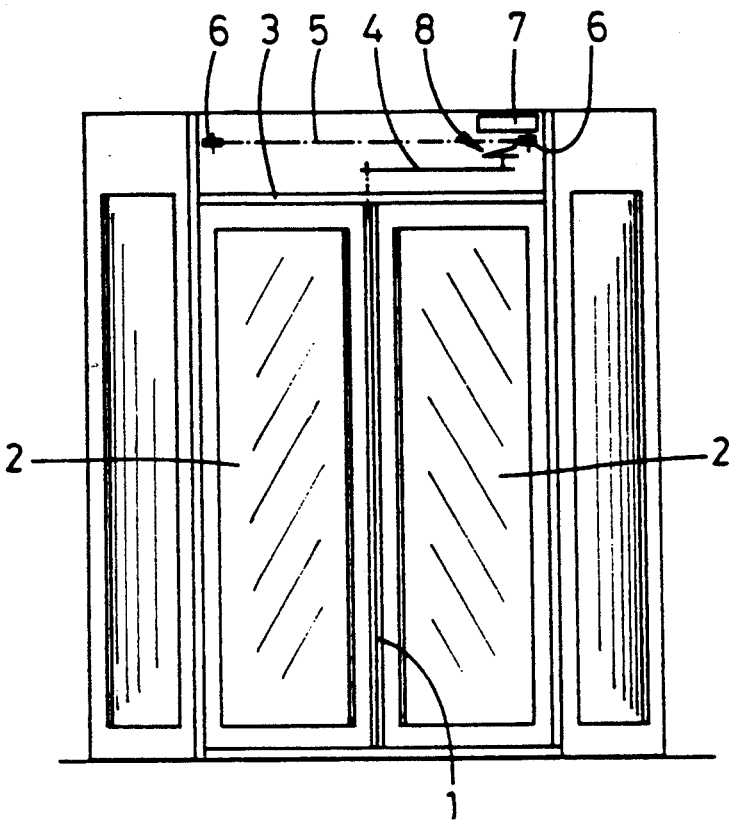
FIG. 1 is a schematic front view of a revolving door according to the invention.

The drawings and in particular FIG. 1 thereof, show a revolving door which, in this embodiment, comprises a central shaft 1, to the periphery of which four vertical radial door wings 2 are suspended at equally spaced distances. Obviously the invention applies equally to revolving doors with a greater or smaller number of door wings and to revolving doors with revolving wings which are suspended in a different manner. In addition the invention also applies to a revolving door having wings which do not rotate around a vertical axis but follow, for instance, an oval path.

The central shaft 1 passes a ceiling plate 3 located above the door winqs 2 of the revolving door. By means of the drive system to be specified hereafter a radial arm 4 rotatably fixed to the central column 1 at a point above the ceiling plate 3 can be made to rotate around the column 1 to drive the door wings 2 of the revolving door.

The drive system of the revolving door according to the invention comprises an elongate driving means—in this case an endless chain 5—which is guided around a number of—in this case six—chain wheels 6, such that in a horizontal plane the endless chain 5 runs along an essentially equilateral hexagonal path, the vertices of which being formed by the chain wheels 6. One of the chain wheels 6 can be driven by a motor—preferably an electric motor 7—to make the chain 5 go round, each of the remaining chain wheels 6 being free to rotate around their respective vertical spindle.

The endless chain 5 is driveably connected to the arm 4 by means of a carrier means 8, which in the embodiment shown consists of two connecting rods 9 and 10, which are at their one end hinged to chain 5 at spaced apart points A, B and at their other end interconnected by means of a two-armed coupling lever 11. The coupling lever 11 provided with two identical arms is in its centre rotatably mounted to a vertical shaft 12 placed on top of the arm 4.

Figure 2:
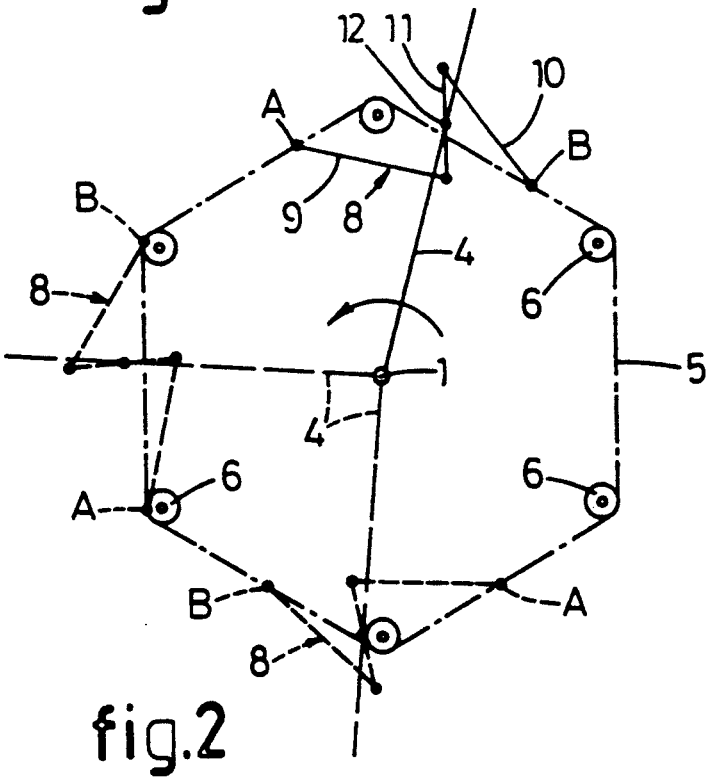
FIG. 2 shows in a strictly schematic top view the principle of the drive system of the revolving door of FIG. 1.

In FIG. 2 one of the positions of the arm 4, and therefore of the door wings 2, is indicated with uninterrupted lines and two other positions are shown by means of dash lines. As can be easily seen the coupling lever 11 counterbalances the variations in the distance between the points A and B by its rotation around the shaft 12. The movement of the arm 4 is, as it were, determined by adding and halving the movements of the points A and B on the chain 5, such that, with the exception of minor irregularities, the component in a radial direction of the arm 4 is absorbed by the carrier means 8, whilst the component in a tangential direction more or less touches on the circular movement of the arm 4. By averaging the tangential components of the speeds at the points A and B the speed variation of the arm 4 is considerably reduced when compared to the situation in which a single rod directly connects only one point of the chain 5 to the arm 4. However, in the present case the frequency of the speed variation is doubled, but does not cause any problem at all.

The invention is not limited to the embodiment shown in the drawings and described above, since it can be varied in several ways within the scope of the invention. For example it would in principle be possible to further extend the carrier means with more than two carrier elements and more than two connection points at the chain 5. In practice, however, a carrier means with two connection points proves to be a satisfactory construction. As already noted, the invention is also applicable to revolving doors with door wings following in principle an oval path. In such cases each door wing can be connected to a bearer movable along an oval rail system, to which bearer the arm 4 can be attached. The drive mechanism according to the invention can also be used in a reverse manner, i.e. in the case of a manually operated door to drive a speed limiter in order to prevent the door from being pushed too fast by hand.

I claim:

1. A revolving door comprising: a number of substantially horizontally turning door wings (2); a drive mechanism for driving said door wings (2), said drive mechanism being provided with elongate driving means (5) running in a substantially horizontal plane along a number of guide units (6) in an essentially polygonal path and operatively engaging at least one door wing (2) by means of carrier means (8), said carrier means (8) comprising at least two hinged carrier elements (9, 10), each engaging the driving means (5) at two spaced apart points (A, B), coupling means (11, 12) interconnecting said carrier elements to each other, said coupling means being movably and drivably connected to said at least one door wing (2).

2. A revolving door as claimed in claim 1, in which said carrier elements (9, 10) consist of elongate connecting members.

3. A revolving door as claimed in claim 2, in which said elongate connecting members (9, 10) are rods.

4. A revolving door as claimed in claim 1, in which said carrier elements (9, 10) comprise one essentially pulling element (9) and one essentially pushing element (10).

5. A revolving door as claimed in claim 1, in which the coupling means (11, 12) is provided with a two-armed lever having two lever arms, said two lever arms being connected to the carrier elements (9, 10), and the lever itself, at a point between said lever arms being hinged to the door wing (2).

6. A revolving door according to claim 4 or 5, in which the length of the driving means (5) between connection points (A, B) with the two carrier elements (9, 10) is in the range from one half to twice the length of a shortest side of said polygon and preferably approximates the length of the shortest side.

7. A revolving door as claimed in claim 1, in which said door wings (2) are connected to a central shaft (1), which in turn is connected to the coupling means (11, 12) through an arm (4).

8. Revolving door as claimed in claim 1, in which the elongate driving means (5) consists of an endless chain.

* * * * *